US009103509B2

(12) United States Patent
Hager

(10) Patent No.: US 9,103,509 B2
(45) Date of Patent: Aug. 11, 2015

(54) LIGHTING DEVICE AND METHOD FOR OPERATING A LIGHTING DEVICE

(75) Inventor: Juergen Hager, Herbrechtingen (DE)

(73) Assignee: OSRAM GmbH, Munich (DE)

( * ) Notice: Subject to any disclaimer, the term of this patent is extended or adjusted under 35 U.S.C. 154(b) by 14 days.

(21) Appl. No.: 14/005,565

(22) PCT Filed: Apr. 2, 2012

(86) PCT No.: PCT/EP2012/055961
§ 371 (c)(1),
(2), (4) Date: Sep. 17, 2013

(87) PCT Pub. No.: WO2012/136626
PCT Pub. Date: Oct. 11, 2012

(65) Prior Publication Data

US 2014/0022809 A1 Jan. 23, 2014

(30) Foreign Application Priority Data

Apr. 4, 2011 (DE) ..... 10 2011 006 699

(51) Int. Cl.
*F21K 99/00* (2010.01)
*F21S 8/10* (2006.01)

(52) U.S. Cl.
CPC ..... *F21K 9/50* (2013.01); *F21S 48/1163* (2013.01); *F21S 48/1388* (2013.01); *F21S 48/1757* (2013.01)

(58) Field of Classification Search
USPC ..... 362/297, 308, 346, 514, 515, 518
See application file for complete search history.

(56) References Cited

U.S. PATENT DOCUMENTS

| | | | | |
|---|---|---|---|---|
| 7,410,282 | B2 | 8/2008 | Eichelberger et al. | |
| 7,524,094 | B2 * | 4/2009 | Fukawa et al. | 362/514 |
| 7,798,675 | B2 * | 9/2010 | Chaves et al. | 362/281 |
| 7,963,684 | B2 | 6/2011 | Staub et al. | |
| 2010/0110711 | A1 * | 5/2010 | Ookubo et al. | 362/514 |
| 2010/0194276 | A1 | 8/2010 | Okubo et al. | |
| 2012/0147618 | A1 * | 6/2012 | Sato et al. | 362/517 |
| 2013/0038736 | A1 | 2/2013 | Yamamura | |

FOREIGN PATENT DOCUMENTS

| | | | |
|---|---|---|---|
| CN | 201425238 | Y | 3/2010 |
| CN | 101793372 | A | 8/2010 |
| DE | 102005043594 | A1 | 3/2007 |
| DE | 102006051029 | A1 | 7/2007 |
| DE | 102007049309 | A1 | 4/2009 |
| DE | 102008010028 | A1 | 8/2009 |
| EP | 1471305 | A1 | 10/2004 |
| EP | 2182274 | A2 | 5/2010 |
| JP | 2009224039 | A | 10/2009 |
| WO | 2011129105 | A1 | 10/2011 |

OTHER PUBLICATIONS

Julio Chaves, "Introduction to Nonimaging Optics", CRC Press, 2008, pp. 25-41.
English language abstract of EP 1471305 A1 of Oct. 27, 2004.
English language abstract of JP 2009224039 A of Oct. 1, 2009.
English language abstract of DE 102005043594 A1 of Mar. 15, 2007.
English language abstract of DE 102008010028 A1 of Aug. 27, 2009.
English abstract of CN 201425238 Y of Mar. 17, 2010.
Office Action issued in the corresponding Chinese application No. 201280013622.7, dated Jul. 2, 2014 (with English translation).

* cited by examiner

*Primary Examiner* — Laura Tso

(57) ABSTRACT

A lighting device may include: at least one two-dimensional semiconductor light source, at least one reflector unit, which can be switched between a plurality of reflector settings, wherein in a first reflector setting, a first reflector surface of the reflector unit can be illuminated by the at least one semiconductor light source, and in a second reflector setting, a second reflector surface of the reflector unit can be illuminated by the at least one semiconductor light source.

18 Claims, 7 Drawing Sheets

LIGHTING DEVICE AND METHOD FOR OPERATING A LIGHTING DEVICE

RELATED APPLICATIONS

This application is a national stage entry according to 35 U.S.C. §371 of PCT application No.: PCT/EP2012/055961 filed on Apr. 2, 2012, which claims priority from German application No.: 10 2011 006 699.3 filed on Apr. 4, 2011.

TECHNICAL FIELD

Various embodiments relate to a lighting device having a two-dimensional semiconductor light source and at least one reflector unit, in particular to a vehicle light. Various embodiments furthermore relate to a method for operating a lighting device.

BACKGROUND

In the automobile sector, headlamps which simultaneously fulfill a plurality of lighting technology functions or light functions (low beam, high beam, cornering light, etc.) are known. In order to generate the light of the light functions, a plurality of light sources are used, which are activated individually or in predetermined groups depending on the light function. In this case, some of the light functions may be produced by one of the other light functions plus dedicated light generation (for example high beam from low beam and an additional wide-emitting light beam, cornering light from daytime running light and an additional laterally oriented light beam, etc.). A disadvantage in this case is that a relatively large number of light sources are required.

In bi-xenon or bi-halogen projection systems for motor vehicles, only a single gas discharge light source is used, in order, with a reflector cavity, a shutter and a projection lens, to switch the low beam function and the high beam function alternately in a motor vehicle headlamp.

Particularly in the case of light functions which have similar requirements in terms of their light distribution pattern but differ in their integral luminous flux, brightness adaptation (dimming) of one light source may be used in conjunction with the same optical unit in order to be able to switch the two light functions alternately. An example of this is the H15 incandescent lamp, which has two filaments, one of which is used only as a light source for daytime running light and position light and both together generate the low beam light.

SUMMARY

Various embodiments provide a lighting device, particularly a vehicle lighting device, which can generate a plurality of light emission patterns in a particularly simple way.

Various embodiments provide a lighting device including: at least one two-dimensional semiconductor light source and at least one reflector unit, wherein the reflector unit is switchable between a plurality of reflector settings and wherein, in a first reflector setting, a first reflector surface of the reflector unit can be illuminated by the semiconductor light source, and in a second reflector setting a second reflector surface of the reflector unit can be illuminated by the semiconductor light source.

The first reflector surface and/or the second reflector surface may be specularly or diffusely reflective.

The at least one two-dimensional light source may in particular include one or more semiconductor light sources, the emitter surface(s) of which has a non-negligible extent in at least two directions (i.e. they are not only point-like or linear).

The at least one semiconductor light source may be equipped with at least one individual and/or common (primary) optical unit for beam guiding, for example at least one Fresnel lens, collimator, etc.

Preferably, the at least one semiconductor light source includes at least one light-emitting diode. Instead of or in addition to inorganic light-emitting diodes, for example based on InGaN or AlInGaP, organic LEDs (OLEDs, for example polymer OLEDs) are generally also usable. If a plurality of light-emitting diodes are used, in particular inorganic light-emitting diodes, these may in particular be arranged directly adjacent to one another. In this case, narrow gaps, which are not clearly perceptible in practice, may exist between neighboring emitter surfaces and thus generate a virtually two-dimensional emitter surface. The inorganic light-emitting diode(s) may be provided in the form of LED chips which are not packaged in a sealed fashion. The LED chips themselves may already have an extended emitter surface.

When there are a plurality of semiconductor light sources, in particular light-emitting diodes, these may illuminate in the same color or different colors. A color may be monochromatic (for example red, green, blue, etc.) or polychromatic (for example white). The light emitted by the at least one semiconductor light source may also be infrared light (for example "IR LED") or ultraviolet light (for example "UV LED"). A plurality of semiconductor light sources may generate mixed light, for example white mixed light. The at least one semiconductor light source may contain at least one wavelength-converting luminous material (conversion LED). The luminous material may, alternatively or in addition, be arranged at a distance from the semiconductor light source ("remote phosphor"). A plurality of semiconductor light sources may be mounted on a common substrate ("submount").

The reflector unit may include one or more elements.

The lighting device has the advantage that only relatively few light sources are required in order to generate even significantly differently shaped emission patterns. Furthermore, this lighting device can be dimmed in a simple way by the use of semiconductor light sources. The use of two-dimensional semiconductor light sources permits homogeneous light distribution, in particular even without using a beam-expanding optical unit, which permits a particularly compact and economical lighting device. Another advantage is relatively simple thermal connectability and consequently effective coolability of the at least one semiconductor light source.

It is one refinement that the at least one light source and the reflector unit are arranged directly adjacent to one another (i.e. without interposed optical elements).

It is one configuration that the lighting device includes at least one further reflector, which is arranged optically downstream of the reflector unit. Thus, the light reflected by the reflector unit may be further deflected and/or shaped. Instead of or in addition to the at least one further reflector, at least one further optical element, for example a lens, may also be arranged optically downstream of the reflector unit.

The at least one further reflector may include one or more reflector elements. The at least one further reflector may, in particular, include at least one dish-like, in particular half-dish, reflector element.

The at least one further reflector may in particular include two reflectors, in particular formed as half-dishes, arranged opposite one another. These two reflectors may have the same or a different base shape and/or size. The at least one further reflector may, in particular, have an elliptical, parabolic, hyperbolic or freeform reflection surface. The at least one further reflector may be faceted or unfaceted.

In different reflector settings, the same, different or partially the same, partially different further reflector elements may be illuminable.

The at least one further reflector element may be configured to be specularly or diffusely reflective.

It is also a refinement that the at least one reflector unit lies in a space delimited by the at least one further reflector element. This permits a particularly compact and simply constructed lighting device.

It is one configuration that at least one of the reflector surfaces deflects the light beam emitted by the at least one light source with shape invariance. The reflector unit may thus be used as an angle rotator in at least one reflector setting. The basic functionality of angle-rotating optical units is described for example in Julius Chaves: "Introduction to Nonimaging Optics", CRC press, 2008.

The deflection angle may, in particular, be greater than 0° and extend up to 180°. The deflection angle may, in particular, be about 90° (perpendicular deflection).

It is another configuration that at least one of the reflector surfaces splits the light beam emitted by the at least one light source into at least two light sub-beams, in particular light sub-beams of the same type. Thus, in particular, a plurality of further reflector surfaces and/or a plurality of reflection regions of a further reflector surface may be illuminated in a simple way. In particular, in one reflector setting the light beam emitted by the at least one light source may not be split and in a reflector setting it may be split.

It is furthermore a configuration that at least one of the reflector surfaces includes two reflector subsurfaces having the same radius (in particular constant) and different orientation. Thus, the light beam emitted by the at least one light source may be split into at least two (in particular precisely two) similar or even essentially identically shaped light sub-beams.

It is also a configuration that a width of at least one of the reflector surfaces corresponds at least essentially to an (optionally cumulative) width of the at least one light source. This permits particularly uniform, large-area illumination of the reflector unit even without an optical unit arranged between the at least one light source and the at least one reflector unit. Alternatively, however, the at least one light source may (cumulatively) also be shorter or longer than the width of at least one of the reflector surfaces.

It is yet another configuration that at least one radius of at least one of the (curved) reflector surfaces corresponds at least essentially to a height of the at least one light source. This supports, in particular, an angle-rotating functionality with a homogeneous light distribution of the angle-deflected light beam.

It is furthermore a refinement that a height of the at least one light source corresponds to a height of at least one of the reflector surfaces.

It is also another configuration that the reflector unit includes a reflector which can be rotated between the reflector settings. In other words, the reflector includes at least two of the reflector surfaces, which can be selectively brought into the beam path of the beam path generated by the at least one semiconductor light source by rotation of the reflector. Advantageously, the rotation of a single body, namely the reflector, is thus sufficient to generate different light emission patterns of the lighting device.

Particularly in this case, but also in general, a reflector which consists of a compact (i.e. not thin, dish-shaped) body is preferred.

It is also a configuration that the reflector unit includes a reflector having the first reflector surface and a mobile "shutter" having at least one shutter reflector surface, wherein in the first reflector setting, the shutter is remote from a light path (i.e. is not illuminable) and the first reflector surface can be illuminated by the at least one semiconductor light source, and in a second reflector setting, the second reflector surface of the reflector unit is formed by means of at least a part of the first reflector surface and the shutter reflector surface. In this way, the reflector can be arranged statically and simple switching-on of reflector subsurfaces is possible. In the second reflector setting, the second reflector surface is thus formed additively.

The at least one shutter reflector surface may be configured to be diffusely or specularly reflective.

It is an alternative refinement that the shutter does not act reflectively but is a light-absorbing shutter.

It is one refinement that, in the second reflector setting, the second reflector surface of the reflector unit is formed by the (entire) first reflector surface and the shutter reflector surface. In this case, the shutter may in particular deflect a light sub-beam reflected by the first reflector surface.

The reflector may, in the first reflector setting, in particular illuminate a first further reflector or reflector region and a second further reflector or reflector region, and in the second reflector setting only one of the further reflectors or reflector regions.

It is also a configuration that, in the second reflector setting, the shutter partially shades the first reflector surface (and in the first reflector setting the shutter consequently does not shade the first reflector surface). The second reflector surface is consequently constituted by the shutter reflector surface and the non-shaded or non-shadeable subsurface of the first reflector surface. This permits particularly low-loss reflection.

It is also a configuration that a radius of the non-shaded part of the first reflector surface corresponds at least essentially to a height of the at least one semiconductor light source. This permits particularly compact angle deflection.

It is yet another configuration that the shutter reflector surface, at least adjacent to the reflector, has a radius which at least approximately corresponds to the radius of the non-shaded part of the first reflector surface, which permits a highly homogeneous light distribution at the transition between the first reflector surface and the shutter reflector surface. For the same purpose, in the second reflector setting, the shutter reflector surface may advantageously follow on at least approximately smoothly from the non-shaded part of the first reflector surface. In particular, a combination of these features permits a large uniformly acting reflection surface in the second reflector setting, taking the shutter into account.

The mobile shutter may, in particular, be mounted displaceably or rotatably.

It is also a configuration that the two-dimensional light source and/or the at least one reflector unit have a base shape which is linearly extruded with respect to its width, i.e. they essentially are configurationally invariant along their width extent. The reflector unit may then, in particular, include a rotatable reflector having a polygonal cross section, in which case at least two different sides may correspond to at least two different reflector surfaces. Alternatively, for example, extrusion along an arcuate curve, in particular rotation of a two-dimensional profile, is also possible.

It is another refinement that an intermediate space between the at least one light source and the at least one reflector unit, in particular its reflector, is laterally covered, for example by corresponding shutter elements.

In general, the lighting devices may also have three or even more reflector settings.

It is a particularly preferred configuration that the lighting device is a vehicle headlamp. A vehicle may, for example, be a motor vehicle (automobile, truck, etc.), bicycle, aircraft, ship, etc.

Various embodiments provide a method for operating a lighting device having at least one two-dimensional light source and at least one reflector unit, wherein the method includes at least the following steps: bringing the at least one reflector unit into a first reflector setting, in which a first reflector surface of the reflector unit is illuminated by the light source, and bringing the at least one reflector unit into a second reflector setting, in which a second reflector surface of the reflector unit is illuminated by the light source.

The method gives the same advantages as the lighting device, and may also be configured in a similar way thereto.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
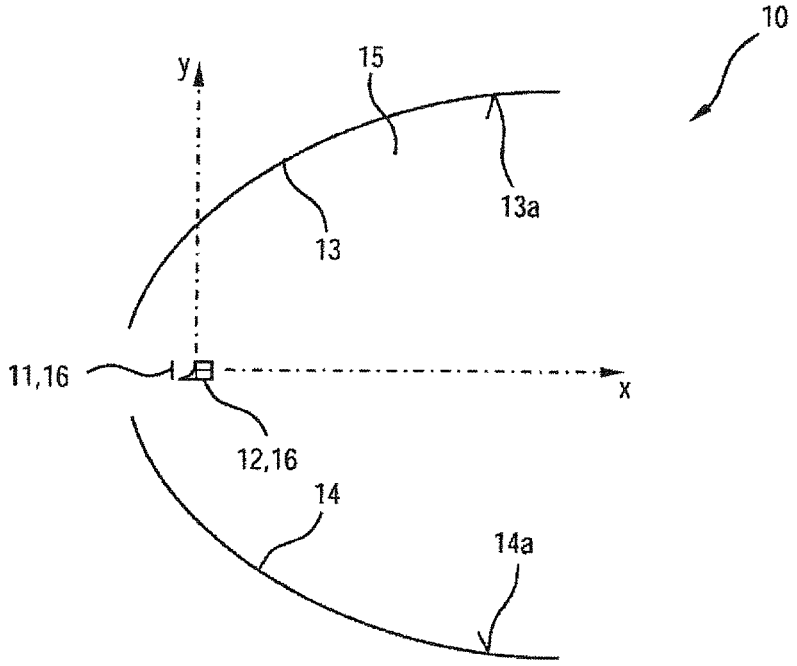
FIG. 1 shows optical components of a lighting device according to a first embodiment in a first reflector setting as a sectional representation in side view.
Figure 2:
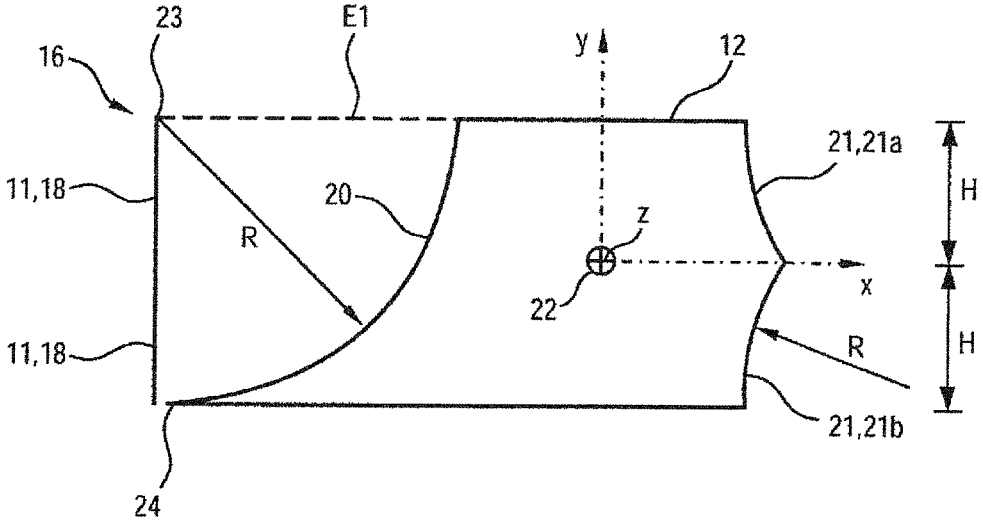
FIG. 2 shows semiconductor light sources and a reflector unit of the lighting device according to the first embodiment in the first reflector setting as a sectional representation in side view.
Figure 3:
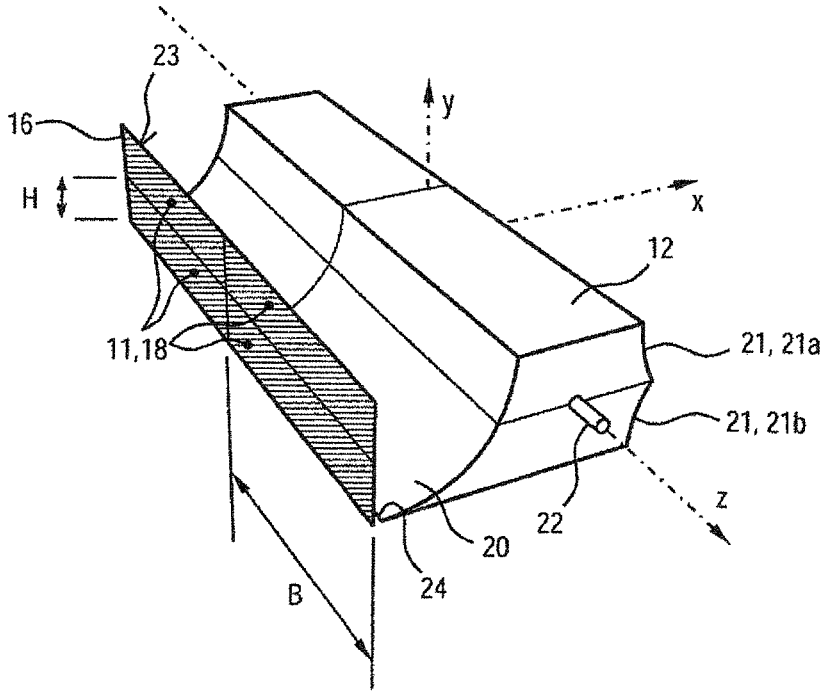
FIG. 3 shows, in a first oblique view, the semiconductor light sources and the reflector unit of the lighting device according to the first embodiment in the first reflector setting.
Figure 4:
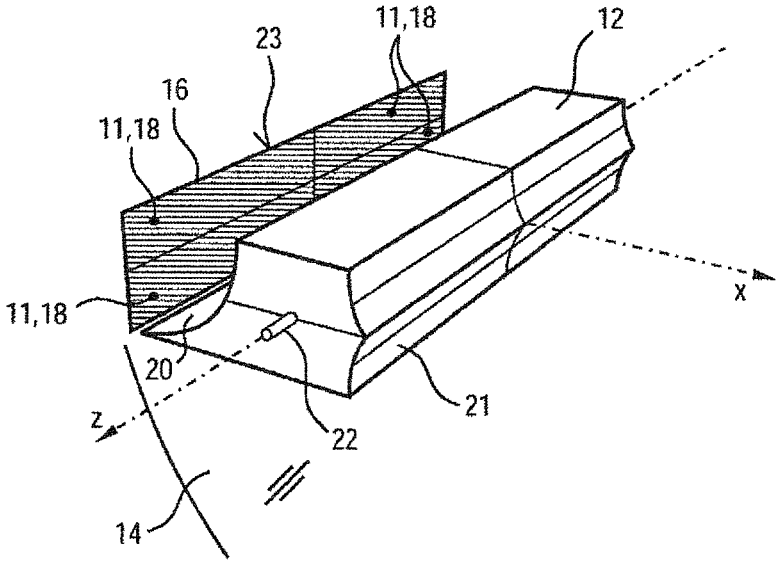
FIG. 4 shows details of the lighting device according to the first embodiment in a second oblique view, in the first reflector setting.

FIG. 1 shows, as a sectional representation in side view, optical components of a lighting device 10 according to a first embodiment, namely two-dimensional semiconductor light sources in the form of light-emitting diodes 11 assembled to form a light generation unit, a reflector unit in the form of a rotatable reflector 12 and two further dish-shaped reflectors 13, 14 arranged downstream of the reflector 12. FIG. 2 shows the light-emitting diodes 11 and the reflector 12 in an enlarged view. FIG. 3 shows the light-emitting diodes 11 and the reflector 12 in a first oblique view and FIG. 4 shows the light-emitting diodes 11 and the reflector 12 together with a part of the further reflector 14.

The dish-shaped reflectors 13 and 14 are each respectively configured as half-dish reflectors having a multiply faceted freeform internal reflection surface 13*a* and 14*a*, respectively. The reflection surfaces 13*a* and 14*a* may be formed to be diffusely or, preferably, specularly reflective. The reflection surfaces 13*a* and 14*a* face toward one another and may respectively be configured sectorwise rotationally symmetrically about an x axis x, the x axis corresponding in this case to a longitudinal axis of the lighting device 10. The reflection surfaces 13*a* and 14*a* may have the same shape and/or size or be formed differently.

The reflectors 13 and 14 delimit an inner space 15, in which the light generation unit 16 is located. The light generation unit 16 includes four light-emitting diodes arranged next to one another in a 2×2 matrix pattern and having two-dimensionally extended emitter surfaces 18, as shown in more detail in FIG. 3 and FIG. 4. The emitter surfaces 18 extend in a (y,z) plane perpendicular to the x axis. The emitter surfaces 18 in this case have a preferred ratio of a width B along the extent of the z axis z to a height H along the extent of the y axis y of 4:1.5, although other length ratios are also possible.

Close to the light generation unit 16, and arranged optically downstream thereof, lies the compact reflector 12. The reflector 12 is formed as a (compact (i.e. in particular as one extended significantly in all three directions) body. The reflector 12 has a longitudinally extruded shape in the extent of the z axis z. A cross-sectional shape is at least approximately rectangular, two oppositely arranged sides constituting a first reflector surface 20 and a second reflector surface 21.

A width of the reflector surfaces 20, 21 corresponds at least approximately to a cumulative width of the light generation unit 16, or of the emitter surfaces 18 of the light-emitting diodes 11 as a group, of about 2·B. Thus, the reflector surfaces 20, 21 can be illuminated uniformly. In general, the width of the reflector surfaces 20, 21 may also be greater or less than the cumulative width of the emitter surfaces 18. The reflector 12 and its reflector surfaces 20, 21 may also be offset laterally (along an extent of the z axis z) relative to the light generation unit 16 and its emitter surfaces 18.

Furthermore, a cumulative height of the light generation unit 16, or of the emitter surfaces 18 of the light-emitting diodes 11, corresponds to a height of the first reflector surface 20 and of the second reflector surface 21.

The reflector surfaces 20, 21 are specularly reflective. The other sides of the reflector 12 may be configured to be (diffusely or specularly) reflective.

Figure 5:
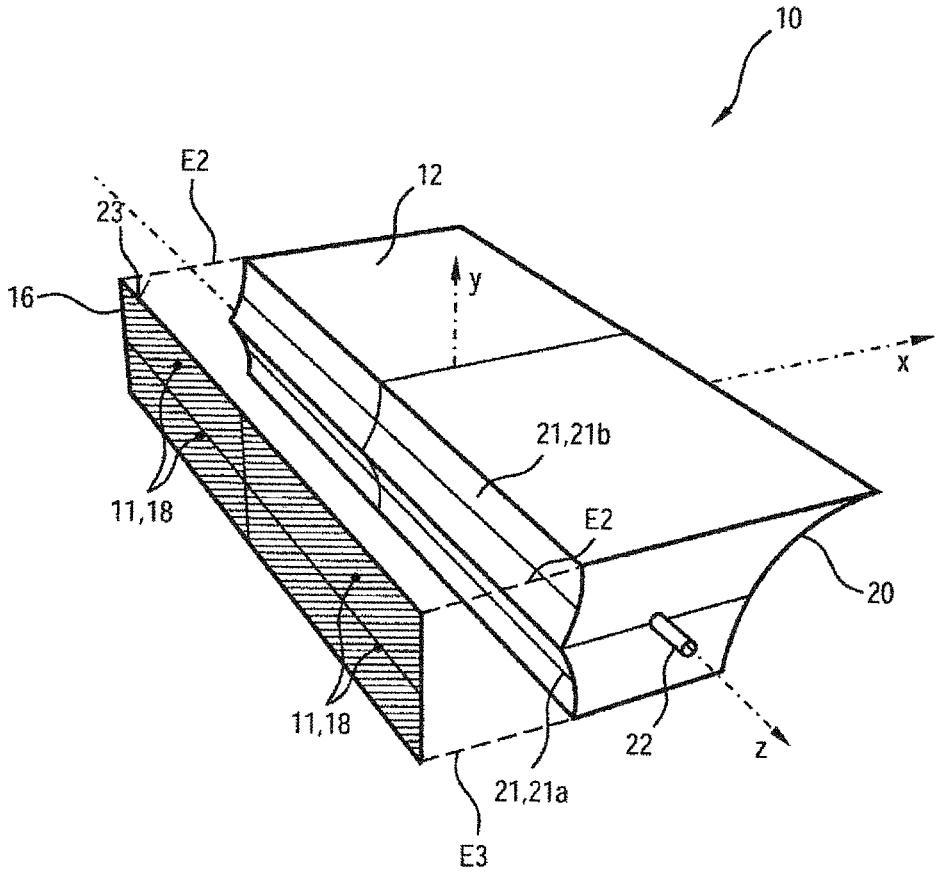
FIG. 5 shows, in an oblique view, the semiconductor light sources and the reflector unit of the lighting device according to the first embodiment in a second, alternative reflector setting.

The reflector 12 is rotatable about the z axis z between a first reflector setting and a second reflector setting. To this end, the reflector 12 laterally includes in each case a pin 22 for engagement of a rotation device (not shown). In the first reflector setting as shown, the first reflector surface 20 faces toward the light generation unit 16 and can therefore be illuminated directly by the latter, and the second reflector surface 21 faces away from the light generation unit 16. In the second reflector setting as shown in FIG. 5, the second reflector surface 21 faces toward the light generation unit 16 and the first reflector surface 20 faces away.

The first reflector surface 20 has at least approximately the shape of a circle sector in profile, here in the form of a quarter circle. A constant radius of curvature R of the first reflector surface 20 in the (x,y) plane corresponds to a distance to an upper extremity 23 of the emitter surfaces 18 of the light generation unit 16. The first reflector surface 20 is furthermore arranged with its lower edge 24 as close as possible to the light generation unit 16.

During operation of the lighting device 10 activated emitter surfaces 18 of the light generation unit in the first reflector setting emit partially upward (in the direction of the y axis y) past the reflector 12 onto the further reflector 13. A greater part of the light generated by the light generation unit 16, however, strikes the first reflector surface 20 and is deflected essentially with shape invariance through 90° upward onto the further reflector 13. The first reflector surface 20 is consequently used as a so-called angle rotator.

For the further reflector 13, a light exit plane E1 formed by the upper extremity 23 and an upper edge of the reflector 12 appears as a "virtual" light source. The upper extremity 23 and the upper edge of the reflector 12 may, in particular, be used as a "cut-off" edge. The light exit plane E1 may, in particular, be located on or in the vicinity of a focal point or a focal plane of the further reflector 13.

After the reflector 12 is switched into the second reflector setting by rotating the reflector 12 through 180°, the second reflector surface 21 now faces toward the light generation unit 16, as shown in FIG. 5.

The second reflector surface 21 is formed mirror-symmetrically in profile with respect to the (x,z) plane with corresponding reflector subsurfaces 21*a* and 21*b*, with the result that the light beam generated by the light generation unit 16 and incident on the second reflector surface 21 is split into two light sub-beams essentially of the same type but deflected into a different direction. The light incident on the second reflector surface 21 is consequently split into equal components. Yet another part of the light generated by the light generation unit 16 passes directly through light exit surfaces E2 and E3, respectively, onto the further reflector surfaces 13, 14. The light exit surfaces E2 and E3, are consequently used as respective "virtual light sources" for the reflectors 13 and 14.

Each of the mutually mirror-symmetrical subsurfaces 21*a*, 21*b* has the same radius of curvature R (although this is not necessary in general) but are oriented differently. By illumination of the second, lower further reflector 14, the lighting device 10 can emit in particular a wide-emitting light pattern.

In the first reflector setting, the lighting device 10 may, in particular, emit low beam light, and in the second reflector setting in particular high beam light.

Because of its proximity to the emitter surfaces 18, the reflector 12 has a base body which preferably consists of a sufficiently thermally and mechanically stable material, in particular metal, for example aluminum, but also plastic, glass, ceramic, etc.

The lighting device 10 may, in particular, be a vehicle light or a part thereof, for example a vehicle headlamp or an insert therefor. Particularly in this case, the possibility of thermally connecting and cooling the light-emitting diodes 11 in a simple way via the side facing away from the reflector 12 is advantageous.

Figure 6:
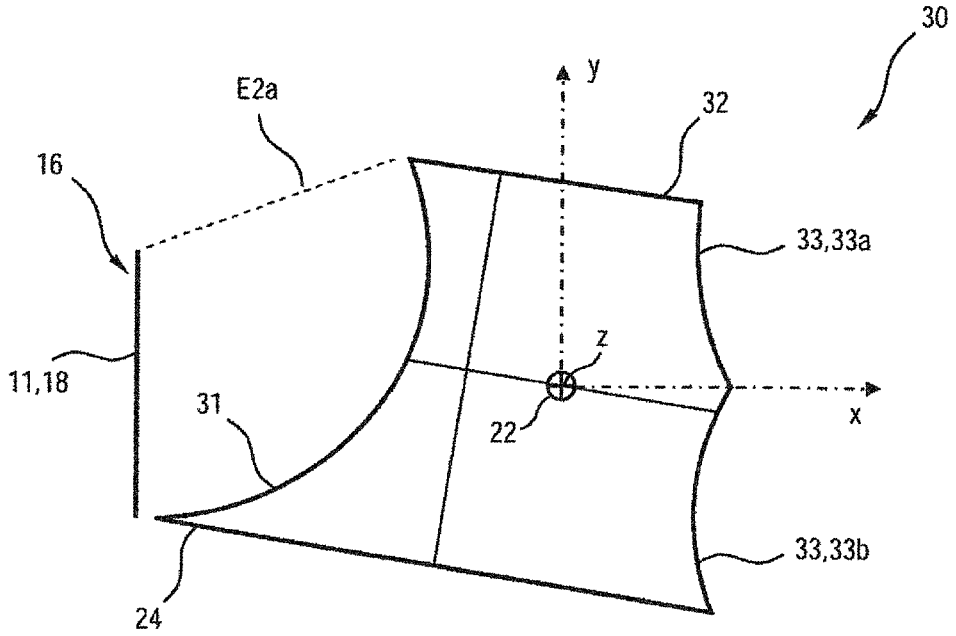
FIG. 6 shows a lighting device according to a second embodiment in a first reflector setting as a sectional representation in side view.

FIG. 6 shows a lighting device 30 according to a second embodiment in a first reflector setting. The lighting device 30 is configured in a similar way to the lighting device 10, although in this case the first reflector surface 31 constitutes a sector section of more than 90° and also does not need to be configured circularly.

Particularly in this case, the light exit plane E2*a* of the reflector 32 of the lighting device 30 is angled with respect to the horizontal (x,z) plane in the first reflector setting, here by about 20°.

The subsurfaces 33*a*, 33*b* of the second reflector surface 33 which are illuminated in the second reflector setting are also no longer formed mirror-symmetrically.

In the first reflector setting, by means of the first reflector surface 31 an angle deflection through about 110° onto the first further reflector 13 is achieved, and in the second reflector setting an angle deflection through about 100° onto the first further reflector 13.

The reflector 32 has, for example, a higher collection efficiency than the reflector 12.

Figure 7:
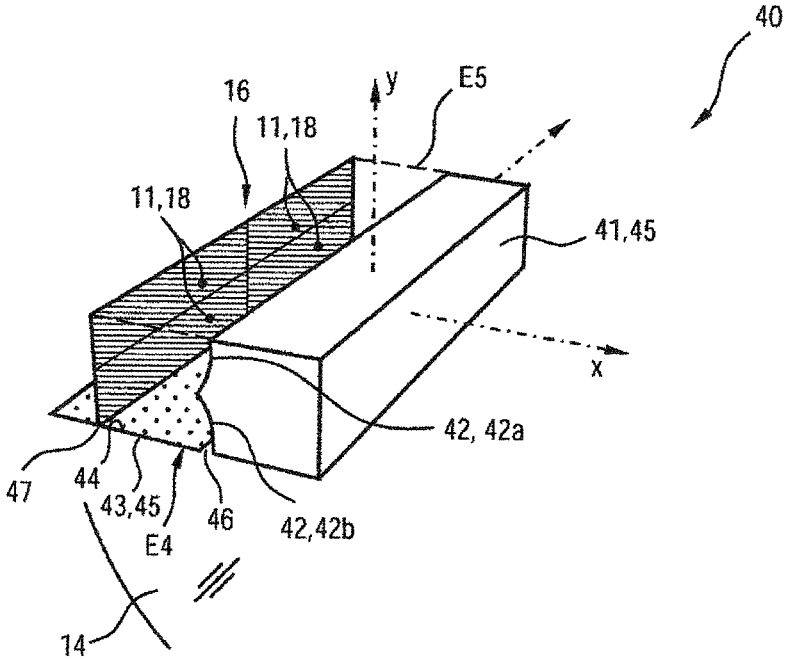
FIG. 7 shows a detail of a lighting device according to a third embodiment in a second reflector setting in a view obliquely from behind.

FIG. 7 shows a detail of a lighting device 40 according to a third embodiment in a second reflector setting in a view obliquely from behind. The lighting device 40 in this case includes a compact reflector 41, which is not rotatable and only has a first reflector surface 42, which faces toward the light generation unit 16. The first reflector surface 42 is at least similar to the second reflector surface 21 of the lighting device 10.

In a first reflector setting (not represented) which is similar to the second reflector setting of the lighting device 10, light incident on the first reflector surface 42 is split into two sub-beams which respectively illuminate the further reflector surface 13 and the further reflector surface 14.

In the second reflector setting as represented, a mobile shutter 43 has been introduced into the light path. The shutter 43 adjoins a lower extremity 47 of the emitter surfaces 18 of the light generation unit 16 and of the reflector 41, and covers the lower light exit surface E4 formed thereby. At least in the region of the light exit surface E4, the shutter 43 has a planar reflective shutter reflector surface 44. The reflector unit 45 is thus formed at least by the reflector 41 and the shutter 43, the second reflector surface 42, 44 corresponding to a combination of the first reflector surface 42 and the shutter reflector surface 44. A width of the shutter 43 corresponds at least to a width of the light generation unit 16, or to its emitter surfaces, and/or to a width of the first reflector surface 42 In the second reflector setting, light is thus prevented from striking the further reflector 14 from below (counter to the y axis y). By the shutter reflector surface 44, this light is shone through an upper light exit opening E5 onto the further reflector 13. Between the first reflector surface 42 and the shutter reflector surface 44, there may be a narrow gap 46.

It is thus possible to switch between the two reflector settings by folding or displacing the shutter 43.

Figure 8:
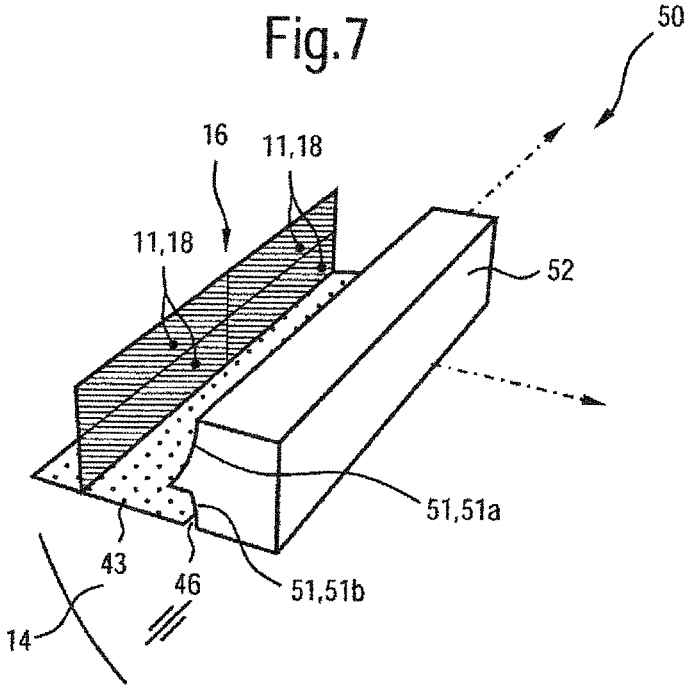
FIG. 8 shows a detail of a lighting device according to a fourth embodiment in a second reflector setting in a view obliquely from behind.

FIG. 8 shows a detail of a lighting device 50 according to a fourth embodiment in a second reflector setting in a view obliquely from behind. The lighting device 50 is similar to the lighting device 40, the first reflector surface 51 of the reflector 52 not being split into mirror-symmetrical arranged subsurfaces, but instead the subsurfaces 51*a*, 51*b* have a different configuration in section. Although the subsurfaces 51*a*, 51*b* are mirror-symmetrical in terms of their shape in this case, and consequently have the same radius of curvature, they are offset along the x axis x.

In particular, by way of example, the subsurface 51*b* in this case has a smaller area, with the result that a smaller light component is assigned to it. In the first reflector setting, definedly less light is consequently shone onto the second further reflector surface 14 than onto the first further reflector surface 13. In general, beam-diverging subsurfaces may be used to generate differently large light components in arbitrary percentages.

Figure 9:
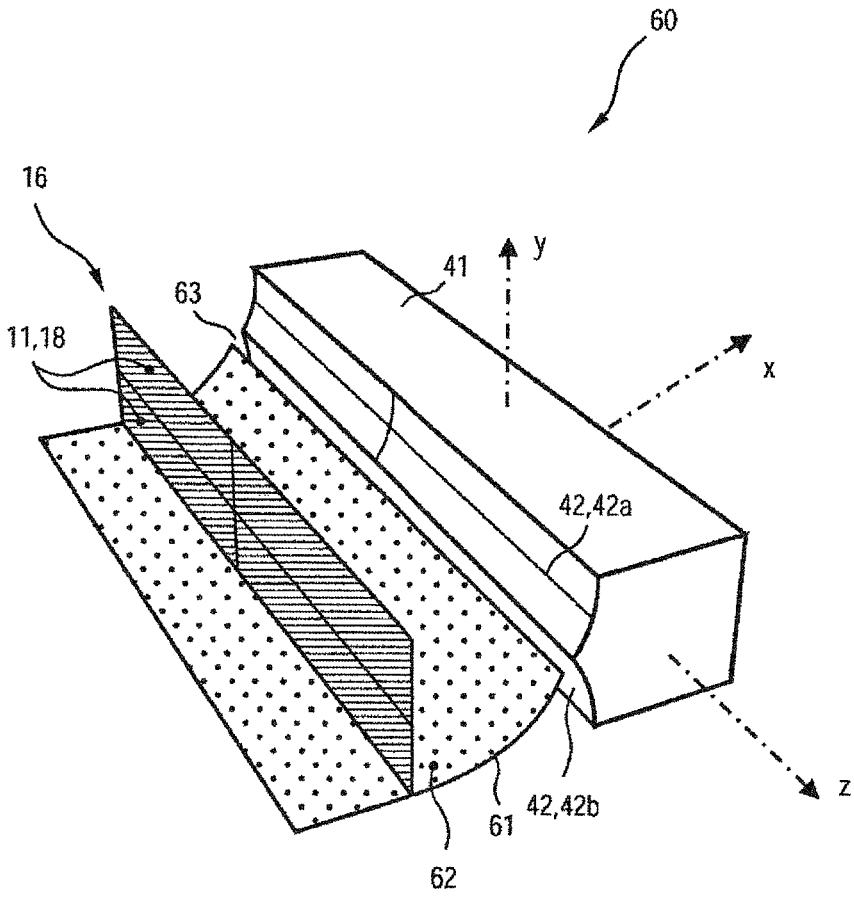
FIG. 9 shows a detail of a lighting device according to a fifth embodiment in a second reflector setting in a view obliquely from behind.

FIG. 9 shows a detail of a lighting device 60 according to a fifth embodiment in a second reflector setting in a view obliquely from behind. The lighting device 60 is similar to the lighting device 40, and also uses the same reflector 41.

In contrast to the lighting device 40, a shutter 61 used here does not have a planar shutter reflector surface, but instead a shutter reflector surface 62 which is curved in profile.

In the first reflector setting, when the shutter 61 is not in the beam path of the lighting device 60, a light emission pattern at least similar to the lighting device 40 in the first reflector setting is generated.

In the second reflector setting, the shutter 61 has been brought into a position in which it shades the reflector subsurface 42*b* of the first reflector surface 42, which directs the light incident from the light generation unit 16 onto the lower further reflector 14. Light which would strike the reflector subsurface 42*b* in the first reflector setting now strikes the shutter reflector surface 62. The non-shaded reflector subsurface 42*a* is illuminated by the light generation unit 16 in the same way in both reflector settings.

Owing to the fact that light now strikes the shutter reflector surface 62, the lower further reflector 14 is not illuminated, but instead the upper further reflector 13 is illuminated more. In particular, the shutter reflector surface 62 adjoins the lower border of the non-shaded reflector subsurface 42*a*, optionally via an only narrow gap 63. This lower border corresponds to the edge which constitutes a transition between the non-shaded reflector subsurface 42*a* and the shaded or shadeable reflector subsurface 42*b*. Light losses can thus be kept small. Furthermore, the non-shaded reflector subsurface 42*a* and the shutter reflector surface 62 are perceived as an essentially unitary second reflector surface 42*a*, 62. The radius of curvature R of the shutter reflector surface 62 corresponds to the radius of curvature R of the non-shaded reflector sub-surface 42*a*. Furthermore, the shutter reflector surface 62 follows on smoothly from the non-shaded reflector subsurface 42*a*, i.e. without a step or edge. The second reflector surface 42*a*, 62 therefore has a uniform radius of curvature R, and consequently acts as an angle-rotating reflector surface.

Figure 10:
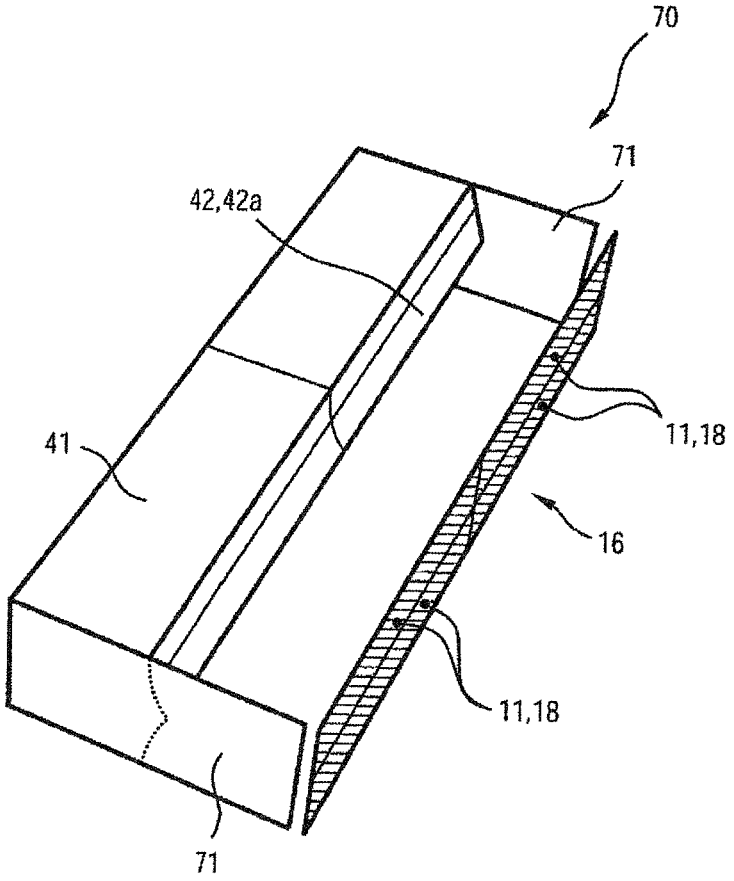
FIG. 10 shows a detail of a lighting device according to a sixth embodiment in a first reflector setting in a view obliquely from behind.

FIG. 10 shows a detail of a lighting device 70 according to a sixth embodiment in a first reflector setting in a view obliquely from behind.

The lighting device 70 corresponds to the lighting device 40 or 60 (with the shutter, which is removed in the first reflector setting, not visible) and additionally includes side shutters 71 protruding laterally on the reflector 41 in the direction of the light generation unit 16. The side shutters 71 may be configured to be specularly or diffusely reflective, or alternatively light-absorbent. By the side shutters 71, a space delimited by the light generation unit 16, in the second reflector setting the shutter 43 or 61, respectively, and the reflector 41 is laterally closed. Use of the shutters 71 permits an increased luminous efficiency, improved light mixing and a reduction of stray light.

Of course, the disclosure is not restricted to the embodiments presented.

For instance, emitter surfaces which do not have a rectangular base shape may in general be used. Also, it is generally possible to use emitter surfaces which do not lie in a plane, but for example are curved. Also, the arrangement of the emitter surfaces is not in general restricted to a matrix pattern, in particular not to a 2×2 matrix pattern. For example, a 1×5 matrix pattern etc. may also be used.

In general, instead of a plurality of light-emitting diodes, a single light-emitting diode having a correspondingly large emitter surface may also be used, in particular an organic LED, for example a polymer LED. This has the advantages of particularly simple driving as well as a unitary emitter surface without gaps.

It is also a general refinement that the number and/or brightness of the activated semiconductor light sources may vary with the reflector setting.

Furthermore, side shutters may be used with all the lighting devices, for example even those which have a rotatable reflector. The side shutters may generally be separate elements and, for example, do not need to be firmly connected to the reflector.

The shutter may also be formed to be diffusely reflective or light-absorbent. This shutter may also be arranged at a distance from the reflector unit. More generally, the shutter may prevent light incidence on a particular reflector or reflector region. The shutter may in general also be formed in the shape of a box or trough.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SYMBOLS

10 lighting device
11 light-emitting diode
12 reflector
13 dish-shaped reflector
13*a* reflection surface
14 dish-shaped reflector
14*a* reflection surface
15 inner space
16 light generation unit
18 emitter surface
20 first reflector surface
21 second reflector surface
21*a* reflector subsurface
21*b* reflector subsurface
22 pin
23 upper extremity
24 lower edge
30 lighting device
31 reflector surface
32 reflector
33 reflector surface
33*a* subsurface
33*b* subsurface
40 lighting device
41 reflector
42 first reflector surface
42*a* reflector subsurface
42*b* reflector subsurface
43 shutter
44 shutter reflector surface
45 reflector unit
46 gap
47 lower extremity
50 lighting device

51 first reflector surface
51*a* subsurface
51*b* subsurface
52 reflector
60 lighting device
61 shutter
62 shutter reflector surface
63 gap
70 lighting device
71 side shutter
B width
E1 light exit plane
E2 light exit plane
E2*a* light exit plane
E3 light exit plane
E4 light exit plane
E5 light exit plane
H height
R radius of curvature
x x axis
y y axis
z z axis

The invention claimed is:

1. A lighting device, comprising at least one two-dimensional semiconductor light source, at least one reflector unit, which can be switched between a plurality of reflector settings, wherein in a first reflector setting, a first reflector surface of the reflector unit can be illuminated by the at least one semiconductor light source, and in a second reflector setting, a second reflector surface of the reflector unit can be illuminated by the at least one semiconductor light source, and wherein the lighting device comprises at least one further reflector which is arranged optically downstream of the reflector unit.

2. The lighting device as claimed claim 1, wherein at least one of the reflector surfaces deflects a light beam emitted onto it by the at least one semiconductor light source at least essentially with shape invariance.

3. The lighting device as claimed in claim 2, wherein the at least one of the reflector surfaces deflects through 90°.

4. The lighting device as claimed in claim 1, wherein at least one of the reflector surfaces splits the light beam emitted by the at least one semiconductor light source into at least two light sub-beams.

5. The lighting device as claimed claim 1, wherein a width of at least one of the reflector surfaces corresponds at least essentially to a width of the at least one semiconductor light source.

6. The lighting device as claimed in claim 1, wherein at least one radius of at least one of the reflector surfaces corresponds at least essentially to a height of the at least one semiconductor light source.

7. The lighting device as claimed in claim 6, wherein a radius of the non-shaded part of the first reflector surface corresponds at least essentially to a height of the at least one semiconductor light source, the shutter reflector surface, at least adjacent to the reflector, has a radius which at least approximately corresponds to the radius of the non-shaded part of the first reflector surface, and in the second reflector setting, the shutter reflector surface follows on at least approximately smoothly from the non-shaded part of the first reflector surface.

8. The lighting device as claimed in claim 1, wherein the reflector unit comprises a reflector which can be rotated between the reflector settings.

9. The lighting device as claimed in claim 8, wherein the reflector is a compact reflector.

10. The lighting device as claimed in claim 1, wherein the reflector unit comprises a reflector having the first reflector surface and a mobile shutter having a shutter reflector surface, wherein in the first reflector setting, the shutter is remote from a light path and the first reflector surface can be illuminated by the at least one semiconductor light source, and in a second reflector setting, the second reflector surface of the reflector unit is formed by means of at least a part of the first reflector surface and the shutter reflector surface.

11. The lighting device as claimed in claim 10, wherein in the second reflector setting, the shutter partially shades the first reflector surface.

12. The lighting device as claimed in claim 11, wherein a radius of the non-shaded part of the first reflector surface corresponds at least essentially to a height of the at least one semiconductor light source, the shutter reflector surface, at least adjacent to the reflector, has a radius which at least approximately corresponds to the radius of the non-shaded part of the first reflector surface, and in the second reflector setting, the shutter reflector surface follows on at least approximately smoothly from the non-shaded part of the first reflector surface.

13. The lighting device as claimed claim 1, wherein the lighting device is a vehicle headlamp.

14. The lighting device as claimed claim 1, wherein the two-dimensional semiconductor light source and the at least one reflector unit has a base shape which is linearly extruded with respect to its width.

15. The lighting device as claimed in claim 1, wherein the at least one further reflector is a dish-like reflector.

16. A lighting device, comprising at least one two-dimensional semiconductor light source, at least one reflector unit, which can be switched between a plurality of reflector settings, wherein in a first reflector setting, a first reflector surface of the reflector unit can be illuminated by the at least one semiconductor light source, and in a second reflector setting, a second reflector surface of the reflector unit can be illuminated by the at least one semiconductor light source and wherein at least one of the reflector surfaces splits the light beam emitted by the at least one semiconductor light source into at least two light sub-beams.

17. The lighting device as claimed in claim 16, wherein the at least two light sub-beams are the same type.

18. The lighting device as claimed in claim 16, wherein at least one of the reflector surfaces comprises two reflector subsurfaces having the same radius and different orientation.

* * * * *